US005462565A

United States Patent [19]

Rohr et al.

[11] Patent Number: 5,462,565

[45] Date of Patent: Oct. 31, 1995

[54] PROCESS FOR DYEING DELUSTERED POLYAMIDE FIBERS WITH ACID DYESTUFFS AND METAL SALTS

[75] Inventors: Jürgen Rohr, Langenfeld; Martin Riegels, Hilden; Sylvia Lohmann, Emmerthal, all of Germany

[73] Assignee: Bayer Aktiengesellschaft, Leverkusen, Germany

[21] Appl. No.: 302,556

[22] Filed: Sep. 8, 1994

Related U.S. Application Data

[63] Continuation of Ser. No. 58,551, May 5, 1993, abandoned.

[30] Foreign Application Priority Data

May 12, 1992 [DE] Germany ..... 42 15 589.4

[51] Int. Cl.[6] ..... C09B 67/24; D06P 3/24

[52] U.S. Cl. ..... 8/531; 8/550; 8/623; 8/626; 8/628; 8/629; 8/662; 8/675; 8/685; 8/907; 8/924

[58] Field of Search ..... 8/531, 623, 626, 8/628, 629, 662, 675, 685, 907, 924

[56] References Cited

U.S. PATENT DOCUMENTS

| | | | |
|---|---|---|---|
| 3,606,693 | 9/1971 | Walz et al. | 8/54 |
| 3,606,988 | 9/1971 | Walz et al. | 8/54 |
| 4,274,831 | 6/1981 | Belfort et al. | 8/532 |
| 4,300,900 | 11/1981 | Putzar et al. | 8/524 |
| 4,935,033 | 6/1990 | Mosimann et al. | 8/543 |
| 5,142,000 | 8/1992 | Wheyland | 525/420 |

FOREIGN PATENT DOCUMENTS 1106693 3/1968 United Kingdom .

OTHER PUBLICATIONS

*Textilveredlung* 20 (1985), No. 11, "Lichtstabilität und Licht-stabilisierung von Polyamidfasern", Reinert, pp. 346–351.

JP 57–089,664 A, Toray Ind. Inc., Jun. 1982, English language Abstract only.

*Textilveredelung*, 24, No. 5 (1989), p. 182 (Summary), Reinert et al.

Derwent Pulications Ltd., JP–57–089,664 (Abstract only), Jun. 1982, Toray Ind. Inc.

*Primary Examiner*—Paul Lieberman
*Assistant Examiner*—Caroline L. Dusheck
*Attorney, Agent, or Firm*—William C. Gerstenzang; Sprung Horn Kramer & Woods

[57] ABSTRACT

The new process for dyeing polyamide fibers with acid dyestuffs, in which small amounts of metal salts are added to the dyebath, gives dyeings having improved lightfastness.

17 Claims, No Drawings

PROCESS FOR DYEING DELUSTERED POLYAMIDE FIBERS WITH ACID DYESTUFFS AND METAL SALTS

This application is a continuation of U.S. application Ser. No. 08/058,551, filed on May 5, 1993, now abandoned.

BACKGROUND OF THE INVENTION

The present invention relates to a new process for dyeing polyamide fibers with acid dyestuffs, which gives dyeings having improved light-fastness.

For most intended uses as textiles, polyamide fibers have to be delustred, which is achieved industrially by the addition of titanium dioxide pigments.

However, it is generally known that the presence of titanium dioxide in polyamide fiber has an adverse effect on its photostability. The more pigmented a fiber is, the less light-fast it is. Efforts are known from the literature to improve the light-fastness of non-dyed polyamide fibers either by addition of metal ions, such as, for example, $Mn^{2+}$, $Cu^{+}$, $Cu^{2+}$ or $Co^{2+}$, to the spinning melt or by surface treatment of the polyamide fiber (Textilveredelung 20, No. 11 (1985), 346 and JP 57 089 654).

Attempts have furthermore been made to improve the light-fastness of dyeings on polyamide by adding copper(II) salts to the dyebath (Textitveredelung 20, loc. cit.). A large excess of copper(II) salt is required here, because of a lack of affinity of the copper ions for the fiber. Organic copper complex compounds have a better fiber affinity. It is known to add such copper complex compounds, in particular those of diazomethine derivatives, to the dyebath to improve the light-fastness of the dyeing (Textilveredelung 24, No. 5 (1989), 182). However, the processes known from the prior art do not satisfy all the requirements. In particular, when dyeing polyamide microfibers which have a high degree of delustring, only dyeings of inadequate light-fastness have been obtainable to date with acid dyestuffs at the acid pH values necessary for these dyestuffs.

The organic copper complexes known from the prior art exhibit little improvement or no-improvement at all in the light-fastness of the resulting dyeing when used for dyeing with acid dyestuffs.

Since particularly deep color shades can be achieved with acid dyestuffs on polyamide, there was thus the need for a dyeing process for acid dyestuffs which gives dyeings of improved light-fastness.

SUMMARY OF THE INVENTION

The present invention relates to a process for dyeing polyamide fibers with acid dyestuffs, characterized in that small amounts of salts of nickel, zinc, cobalt, zirconium or manganese are added to the dyebath. Surprisingly, the dyeings obtained by the process according to the invention exhibit an improved light-fastness.

DETAILED DESCRIPTION OF THE INVENTION

The process according to the invention is suitable for dyeing polyamide fibers having a fiber thickness of 0.6 to 3 dtex, in particular ultra-dull microfibers having a fiber thickness of 0.6 to 1.2 dtex. Ultra-dull polyamide fibers in general comprise up to 2% of titanium dioxide pigments. The particle size of the pigments employed is in general 0.1 to 1 μm.

All the inorganic and organic salts, such as, for example, chlorides, nitrates, sulphates, acetates, phosphates, formates, oxalates or lactates, of the metals mentioned are, in principle, suitable for carrying out the process according to the invention. Organic manganese(II) salts, such as, in particular, manganese acetate, are preferably employed. The metal salts mentioned are preferably added to the dyebath during the dyeing operation in amounts of 0.1 to 1 g/l, preferably 0.1 to 0.5 g/l.

The metal salts mentioned can also be employed in any desired mixture with one another and as a mixture with Cu(I) salts and Cu(II) salts.

Acid dyestuffs which are suitable for carrying out the process according to the invention are azo, anthraquinone and metal complex dyestuffs or combinations thereof which have to be used for dyeing in an acid pH range below pH 6 for exhaustion of the bath.

Examples which may be mentioned are:

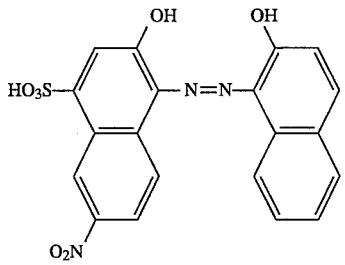

Acid Black 172

-continued

Acid Yellow 242

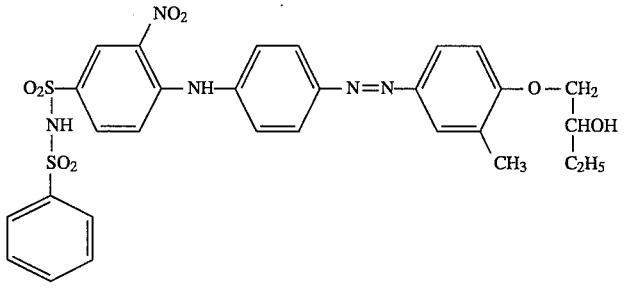

Acid Orange 33

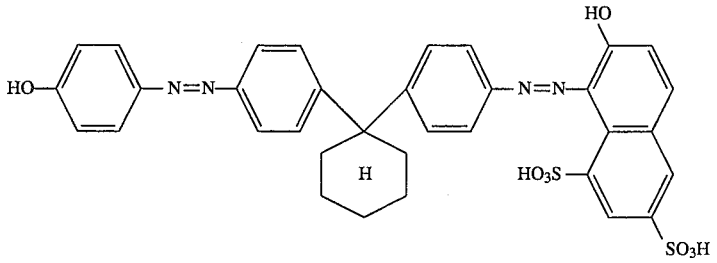

Acid Red 158

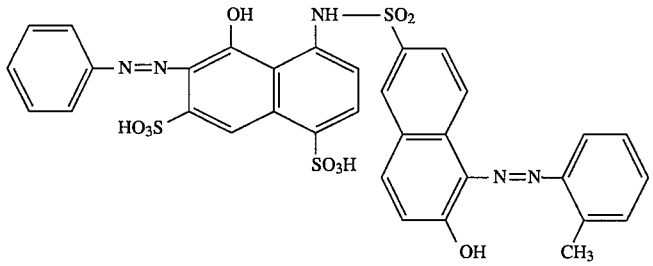

Acid Red 299

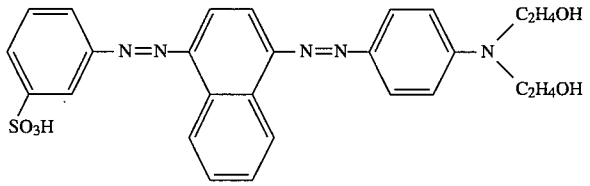

Acid Blue 264

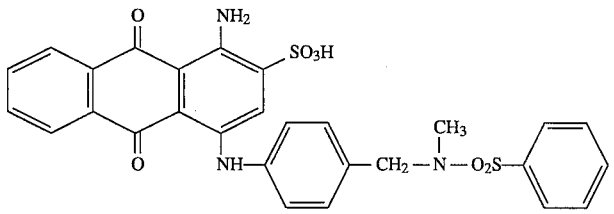

Acid Blue 290

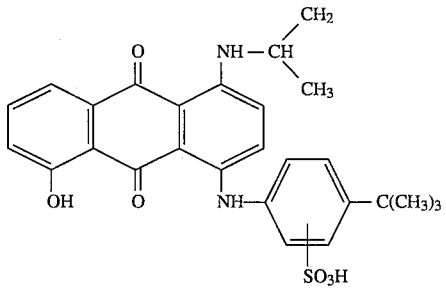

Dyeing by the process according to the invention is in general carried out under the conditions customary for dyeings with acid dyestuffs on polyamide, that is to say at a temperature of 85° to 110° C. and a pH of below 6, preferably between 4.0 and 6.

In a preferred embodiment of the process according to the invention, a complexing agent which is capable of forming a complex with the metal ions mentioned is added to the dyebath. Examples of possible complexing agents are: gluconic acid; polyaminopolycarboxylic acids; phosphorus compounds, such as tripolyphosphates, ortho-phosphates, phosphonic acid and phosphono-alkane-polycarboxylic acids, such as 2-phosphonobutane-1,2,4-tricarboxylic acid; polycarboxylic acids such as citric acid and ethylenediaminetetraacetic acid and polyacrylic acids and derivatives thereof.

In an embodiment of the process according to the invention which is likewise preferred, a dispersing agent is added to the dyebath, preferably an anionic dispersing agent, for example from the series of polycondensates of:

—various alkylarylsulphonic acids with halogenoarylsulphonic acids

—sulphonated phenols, β-naphthols and the like with formaldehyde and various nitrogen compounds —reactive alkylaryl compounds with aromatic sulphonic acids, such as, for example, benzyl chloride with naphthalenesulphonic acid —diphenyl ether derivatives and the like with aryl-sulphonates and formaldehyde —cresolsulphonic acids with formaldehyde —urea/formaldehyde with phenolsulphonic acid —phenol and formaldehyde, which are sulphomethylated, and the series of ligninsulphonates, such as are described, for example, in Chwala/Anger, Handbuch der Textilhilfsmittel (Handbook of Textile Auxiliaries), 2nd Edition, Verlag Chemie, Weinheim 1977, page 506 et seq.

In an embodiment of the process according to the invention which is furthermore preferred, a surface-active auxiliary is added to the dyebath. Preferred possible surface-active auxiliaries are:

1. a) water-soluble polyalkylene glycol ethers containing basic nitrogen atoms, such as are described, for example, in German Auslegeschrift 1 619 652, b) alkoxylated fatty amines of the general formula

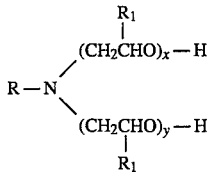

wherein

R represents $C_{12}$–$C_{22}$-alkyl, $C_{12}$–$C_{22}$-alkenyl or $C_{12}$–$C_{22}$-cycloalkenyl, x and y independently of one another represent a number from 5 to 70, preferably 15 to 50, and $R_1$ represents hydrogen, methyl, ethyl or phenyl, c) reaction products of alkylamines having 12 to 22 C. atoms with formaldehyde, phenols and 15–50 equivalents of ethylene oxide, it being possible for components a), b) and c) to be employed as individual compounds or as mixtures with one another.

2. Compounds of the formula (compare German Auslegeschrift 1 940 178 and EP 305 858)

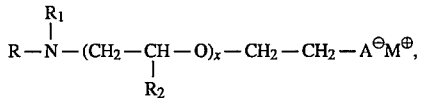

wherein

R represents $C_{12}$–$C_{22}$-alkyl, $C_{12}$–$C_{22}$a-alkenyl or $C_{12}$–$C_{22}$-cycloalkyl, $R_1$ represents $C_1$–$C_4$-alkyl or a group of the formula $$-(CH_2-CHR_2-O)_y-H \text{ or } -(CH_2-CHR_2-O)_y-CH_2-CH_2-A^{\ominus}M^{\oplus},$$

$R_2$ represents H, methyl, ethyl or phenyl, $M^{\oplus}$ represents a Cation, in particular an alkali metal, alkaline earth metal or ammonium ion or a mono-, di- or triethanolammonium ion, $A^{\ominus}$ represents an anionic group, in particular $SO_4^{\ominus}$ or $SO_3^{\ominus}$, and x and y independently of one another represent a number from 5 to 70, preferably 15 to 50, or quaternization products thereof of the formula

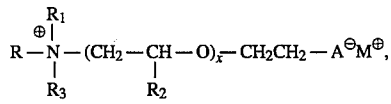

wherein

R, $R_1$, $R_2$, $M^{\oplus}$, $A^{\ominus}$, x and y have the abovementioned meaning and $R_3$ represents $C_1$–$C_8$-alkyl which is optionally substituted by hydroxyl, carboxyl, lower carbalkoxy or carboxamide (compare German Aus legeschrift 1 940 178 and EP 305 858).

3. a) Alkoxylated fatty alcohols (compare EP 312 493) of the formula $$RO(CH_2CHR_1O)_x-H$$

wherein

R represents $C_{12}$–$C_{22}$-alkyl, $C_{12}$–$C_{22}$-alkenyl or $C_{12}$–$C_{22}$-cycloalkyl, $R_1$ represents H, methyl, ethyl or phenyl and x represents 12–60, and/or b) quaternized ammonium compounds of polyglycol compounds of the formula

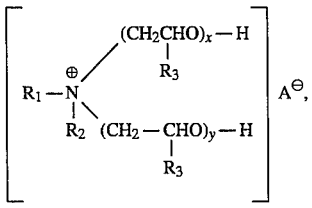

wherein $R_1$ represents alkyl or alkenyl having in each case 12 to 22 carbon atoms, $R_2$ represents $C_1$–$C_8$-alkyl which is optionally substituted by hydroxyl, carboxyl, lower carbalkoxy or carboxamide, $R_3$ represents H, methyl, ethyl or phenyl, x and y independently of one another represent a number from 5 to 50, preferably 15 to 50, and $A^{\ominus}$ represents an anion, preferably $Cl^{\ominus}$ or the methylsulphate anion.

4. Surface-active compounds containing sulphuric acid ester groups or sulphonic acid groups, such as (see also German Auslegeschrift 1 920 357)

a) alkylarylsulphonic acids, b) alkanesulphonic acids, c) amides of higher molecular weight fatty acids and aminoalkylsulphonic acids, d) sulphated, higher molecular weight fatty acids or esters thereof and e) alkylsulphates, such as sodium dodecylsulphate, alkyl ether-sulphates (for example such as 3a) and alkyl polyether-sulphates.

Possible sulphated, higher molecular weight fatty acids and esters thereof are:

—sulphation products of oleic or elaidic acid or of ricinoleic acid and alkyl esters thereof, for example the methyl, ethyl, propyl or butyl ester, or of the glycerol ester of these fatty acids, for example of castor oil.

5.Sulphonated, aromatic condensation products, for example of naphthalene, formaldehyde and sulphuric acid.

6. Compounds of the formula (compare Auslegeschrift 2 945 102)

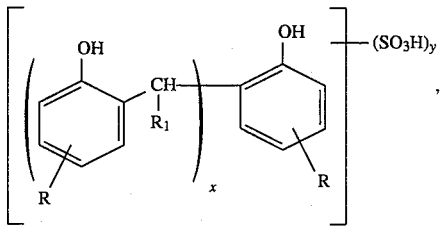

wherein

R represents $C_4$–$C_{12}$-alkyl, $C_1$–$C_{12}$-alkoxy, phenyl, cyclohexyl or $C_2$–$C_8$-hydroxyalkyl, $R_1$ represents H or $C_1$–$C_4$-alkyl, x represents an integer from 1 to 10 and y represents numbers from 1 to x+1.

7. a) Compounds of the formula (compare German Auslegeschrift 1 444 267)

$$R(A)_xR_1$$

wherein

R represents sulphonated benzene or naphthalene rings, $R_1$ represents sulphonated benzene or naphthalene rings, A represents $CH_2$, $SO_2$ or NH and x represents 0 to 4, or b) a weakly cationic complexing agent, such as, for example, polyvinylpyrrolidone, or a condensation product of ethylene oxide with a long-chain fatty amine.

8. Polyglycol ethers of phenols or naphthols which contain sulpho groups and are substituted by hydrocarbons (compare German Auslegeschrift 1 288 066)

$$HO_3S-\underset{\underset{R}{|}}{Ar}-O(CH_2-\underset{\underset{R_1}{|}}{CHO})_xCH_2-\underset{\underset{R_1}{|}}{CH}-X,$$

wherein

Ar represents a benzene or naphthalene radical,

R represents a hydrocarbon radical, in particular cycloalkyl, an aralkyl radical or an alkyl radical having at least 7 carbon atoms, $R_1$ represents H or methyl, x represents 1 to 8 and X represents OH, Cl, CN, O-alkyl or OOC-alkyl or an anionic atomic grouping, such as $OSO_3H$, $OPO_3H_2$ or $OCH_2CO_2H$; and furthermore the alkali metal or ammonium salts of these compounds and their salts with amines, for example ethanolamine, diethanolamine, triethanolamine and cyclohexylamine.

The complexing agents, dispersing agents and surface-active agents mentioned can in principle be added to the dyebath either individually or as any desired mixture with one another for carrying out the process according to the invention.

The complexing agents mentioned are added to the dyebath in general amounts of 0.1 to 5 g/l, preferably 0.5 to 2 g/l.

The dispersing agents mentioned are added to the dyebath in general amounts of 0.1 to 5 g/l, preferably 0.5 to 2 g/l.

The surface-active agents mentioned are added to the dyebath in general in amounts of 0.5 to 4%, preferably 1 to 2%, based on the weight of the polyamide fiber goods to be dyed.

Of the complexing agents mentioned, phosphonoalkane-polycarboxylic acids, such as 2-phosphonobutane-1,2,4-tricarboxylic acid, are preferred. Of the dispersing agents mentioned, condensation products of naphthalenesulphonic acid and formaldehyde are preferably employed.

Of the surface-active agents mentioned, alkoxylated fatty alcohols and the compounds mentioned under 1. are of particular importance.

In an especially preferred embodiment of the process according to the invention, the combination of the following surface-active agents is added to the dyebath: 0.05–2.5 g/l of a mixture (M) comprising 25–35 parts by weight of a water-soluble polyalkylene glycol ether containing basic nitrogen atoms, 4–6 parts by weight of an alkoxylated fatty amine, 1–3 parts by weight of a reaction product of alkylamines with formaldehyde, phenol and ethylene oxide and 30–56 parts by weight of water, the parts by weight in each case being based on the total mixture (M), and 0.05–2.5 g/l of an alkoxylated fatty alcohol.

Example 1

A polyamide microfiber (extra-dull woven goods of 1.15 dtex), which was washed, desized and fixed, was dyed for 60 minutes with a mixture of 1% of C.I. Acid Yellow 242, 2% of C.I. Acid Blue 264 and 1% of C.I. Acid Blue 290 by the high temperature process (liquor ratio of 1:20) at 110° C. and a pH of 5 in the presence of 0.1 g/l of manganese(II) acetate, 1.0 g/l of a commercially available surface-active agent comprising polyalkylene glycol ether (LEVEGAL LpA®) and 1.0 g/l of a surface-active agent comprising the reaction product of oleyl alcohol with 50 equivalents of ethylene oxide.

What is claimed is:

1. A process for improving the colorfastness of polyamide fibers delustered by the addition of titanium dioxide pigments and dyed with acid dyestuffs, which comprises dyeing polyamide fibers, having a fiber thickness of 0.6 to 1.2 dtex and containing titanium dioxide pigments, with acid dyestuffs, wherein a small amount of a salt of nickel, zinc, cobalt, zirconium or manganese is added to the dyebath in an amount of 0.1 to 1 g/l.

2. The process of claim 1, wherein a small amount of a metal salt in the form of the chloride, nitrate, sulphate, acetate, phosphate, formate, oxalate or lactate is added to the dyebath.

3. The process of claim 2, wherein the metal salt is a salt of manganese (II).

4. The process of claim 6, wherein the salt is added in an amount of 0.1 to 0.5 g/l.

5. The process of claim 1, wherein the acid dyestuffs are azo dyestuffs, anthraquinone dyestuffs, metal complex dyestuffs or mixtures thereof.

6. The process of claim 1, wherein a complexing agent, an anionic dispersing agent, a surface-active agent or mixtures thereof is added to the dyebath.

7. The process of claim 6, wherein the complexing agent is selected from the group consisting of gluconic acid tripolyphosphates, ortho-phosphates, phosphonic acid, 2-phosphonobutane-1,2-4-tricarboxylic acid, citric acid, ethylenediaminetetraacetic acid, polyacrylic acids and derivatives thereof.

8. The process of claim 7, wherein the complexing agent is a phosphonoalkanepolycarboxylic acid.

9. The process of claim 6, wherein the anionic dispersing agent is selected from the group consisting of (1) polycondensates of alkylarylsulphonic acids with halogenoarylsulphonic acids, sulphonated phenols, β-naphthols with formaldehyde and nitrogen compounds, reactive alkylaryl compounds with aromatic sulphonic acids, diphenyl ether derivatives with arylsulphonates and formaldehyde, cresolsulphonic acids with formaldehyde, urea/formaldehyde with phenolsulphonic acid, and (2) ligninsulphonates.

10. The process of claim 9, wherein the dispersing agent is a condensation product of naphthalenesulphonic acid and formaldehyde.

11. The process of claim 1, wherein one or more surface-active agents are added to the dyebath.

12. The process of claim 1, wherein a combination of a water-soluble polyalkylene glycol ether containing basic nitrogen atoms, an alkoxylated fatty amine and a reaction product of alkylamines with formaldehyde, phenols and ethylene oxide is added to the dyebath as a surface-active agent.

13. The process of claim 1, wherein dyeing is carried out at a temperature of 85° to 110° C.

14. The process of claim 1, wherein dyeing is carried out at a pH of below 6.

15. The process of claim 14, wherein dyeing is carried out at a pH of between 4 and 6.

16. The process of claim 1, wherein a surface-active agent selected from the group consisting of alkoxylated fatty alcohols, water-soluble polyalkylene glycol ethers containing basic nitrogen atoms, alkoxylated fatty amines of the formula

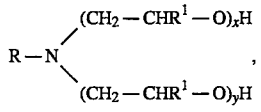

wherein

R represents $C_{12}$–$C_{22}$-alkyl, $C_{12}$–$C_{22}$-alkenyl or $C_{12}$–$C_{22}$-cycloalkenyl, x and y independently of one another represent a number from 5 to 70, and $R^1$ represents hydrogen, methyl ethyl or phenyl, and reaction products of alkylamines having 12 to 22 C atoms with formaldehyde, phenols and 15–50 equivalents of ethylene oxide is added to the dyebath.

17. The process of claim 16, wherein e combination of the following surface-active agents is added to the dyebath: 0.05–2.5 g/l of a mixture comprising 25–35 parts by weight of a water-soluble polyalkylene glycol ether containing basic nitrogen atoms, 4–6 parts by weight of an alkoxylated fatty amine, 1–3 parts by weight of a reaction product of alkylamines with formaldehyde, phenol and ethylene oxide and 30–56 parts by weight of water, the parts by weight in each case being based on the total mixture, end 0.05–2.5 g/l of an alkoxylated fatty alcohol.

* * * * *

UNITED STATES PATENT AND TRADEMARK OFFICE

CERTIFICATE OF CORRECTION

PATENT NO. : 5,462,565
DATED : October 31, 1995
INVENTOR(S) : Rohr, et al

It is certified that error appears in the above-indentified patent and that said Letters Patent is hereby corrected as shown below:

| | |
|---|---|
| Col. 9, line 5 | Delete " claim 6 " and substitute -- claim 1 -- |
| Col. 10, line 37, last line | Delete " end " and substitute -- and -- |

Signed and Sealed this

Thirteenth Day of February, 1996

Bruce Lehman

*Attest:*

BRUCE LEHMAN

*Attesting Officer*

*Commissioner of Patents and Trademarks*